US005656130A

United States Patent [19]

Ali

[11] Patent Number: 5,656,130

[45] Date of Patent: Aug. 12, 1997

[54] AMBIENT TEMPERATURE PULP BLEACHING WITH PEROXYACID SALTS

[75] Inventor: Omar F. Ali, Morrisville, Pa.

[73] Assignee: Union Camp Holding, Inc., Wilmington, Del.

[21] Appl. No.: 430,554

[22] Filed: Apr. 28, 1995

[51] Int. Cl.[6] ..... D21C 9/147; D21C 9/153; D21C 9/16

[52] U.S. Cl. ..... 162/65; 162/78

[58] Field of Search ..... 162/65, 76, 78, 162/80, 83, 84, 86, 88, 89, 90

[56] References Cited

U.S. PATENT DOCUMENTS

| | | | |
|---|---|---|---|
| 4,404,061 | 9/1983 | Cael | 162/76 |
| 4,459,174 | 7/1984 | Papageorges et al. | 162/40 |
| 4,579,628 | 4/1986 | Rernard et al. | 162/85 |
| 4,617,090 | 10/1986 | Chum et al. | 162/16 |
| 4,756,800 | 7/1988 | Springer et al. | 162/64 |
| 5,091,054 | 2/1992 | Meier et al. | 162/65 |
| 5,145,557 | 9/1992 | Peter et al. | 162/65 X |
| 5,164,043 | 11/1992 | Griggs et al. | 162/65 X |
| 5,173,153 | 12/1992 | Terrett et al. | 162/65 X |
| 5,174,861 | 12/1992 | White et al. | 162/65 X |
| 5,328,564 | 7/1994 | Jiang et al. | 162/65 X |
| 5,411,633 | 5/1995 | Phillips et al. | 162/65 X |
| 5,411,635 | 5/1995 | Francis et al. | 162/65 |
| 5,464,501 | 11/1995 | Kogan | 162/65 X |

FOREIGN PATENT DOCUMENTS

| | | |
|---|---|---|
| 94/06964 | 3/1994 | WIPO . |
| 94/12721 | 6/1994 | WIPO . |
| 94/12722 | 6/1994 | WIPO . |

OTHER PUBLICATIONS

Lindholm, "Sekaline Extraction of Ozone Bleached Pulp . . . "; *J. Pulp & Paper*, May 1993, pp. 5108–5113.

M. Hammann et al., "Bleaching Of Kraft Pulp And Asam Pulp Without Chlorine Containing Chemicals", International Pulping Bleaching Conference, Stockholm, Sweden, vol. 3, pp. 185–200 (Jun. 11–14, 1991).

A.J. Ragauskas, Bleaching Fundamentals, IPST Project 3728, pp. 29–38 "Bleaching With Dimethyldioxirane".

*Primary Examiner*—Arthur L. Corbin
*Attorney, Agent, or Firm*—Pennie & Edmonds

[57] ABSTRACT

The present invention relates to a Kraft pulp bleaching stage which is to be carried out after conventional bleaching stages to high brightness. It has been discovered that ambient-temperature bleaching with inorganic peroxy acid salts, such as peroxymonosulfates, at this point can provide substantial increases in pulp brightness without significant decreases in pulp viscosity. Peroxy acid bleaching according to the present invention is carried out at ambient temperature and no greater than about 40° C. and at an initial pH that is slightly alkaline and preferably about 7.25.

25 Claims, 4 Drawing Sheets

AMBIENT TEMPERATURE PULP BLEACHING WITH PEROXYACID SALTS

FIELD OF THE INVENTION

This invention relates to the bleaching of wood pulp. In particular, the present invention relates to an ambient-temperature bleaching stage which is carried out after conventional bleaching stages with inorganic peroxy acid salts, such as peroxymonosulfates, to provide substantial increases in pulp brightness without causing significant decreases in pulp viscosity.

BACKGROUND OF THE INVENTION

The processing of chemical cellulosic pulps in the manufacture of various grades of paper and paper products generally requires that such pulps be subjected to several successive bleaching treatments. These bleaching treatments are optionally interspersed with various washing, dilution, extraction and/or concentration stages in order to arrive at a final product having a desired brightness.

It has been conventional for many years to delignify and bleach wood pulp by using elemental chlorine. Environmental as well as processing problems with chlorine bleaching have led to the development of bleaching processes in which oxygen replaces chlorine as the primary pulp bleaching agent. Oxygen, however, is not as selective a delignification agent as elemental chlorine. The lignin content of the pulp can be reduced only to a limited extent before the oxygen attacks the cellulosic fibers therein. Although the remaining lignin can be removed with chlorine and/or chlorine dioxide, much research in recent years has been devoted to the search for effective ways in which oxygen-bleached pulp can be further delignified with chemicals other than chlorine compounds.

Ozone has been studied as an alternative further bleaching agent for oxygen-bleached pulp. Although ozone may initially appear to be an ideal material for bleaching lignocellulosic materials, its exceptional oxidative properties and relatively high cost have limited the development of satisfactory ozone bleaching processes, especially for the intractable southern softwoods. Ozone will readily react with lignin to effectively reduce the K Number but it will also under most conditions aggressively attack the carbohydrate of the cellulosic fibers, thus substantially reducing the strength of the resulting pulp.

In an effort to overcome these disadvantages, those working in this field have extensively examined numerous alternative bleaching processes designed to reduce or eliminate the use of elemental chlorine and chlorine-containing compounds from multi-stage bleaching processes for lignocellulosic pulps. These alternative processes utilize, for example, various combinations of oxygen ("O"), ozone ("Z"), alkaline extraction ("E") and peroxides ("P"), to name the primary chemicals used. Complicating these efforts, however, is the requirement that high levels of pulp brightness are necessary for many of the applications for which such pulp is to be used. The prior art processes which utilize these materials in various combinations are, however, often unable to achieve these high pulp brightness levels without an unacceptable loss in pulp strength.

One commercially successful chlorine-free bleaching sequence is disclosed by Griggs et al. in U.S. Pat. Nos. 5,164,043 and 5,164,044. These patents disclose multi-stage processes for delignifying and bleaching a lignocellulosic material. Initially, a pulp is formed from the lignocellulosic material by Kraft pulping, Kraft AQ pulping or extended delignification. The pulp is then partially delignified with oxygen preferably according to a modified alkaline addition technique where the alkaline material is substantially uniformly combined with the pulp at low consistency prior to removing pressate and forming a high consistency pulp which is then contacted with the oxygen. Next, the partially delignified pulp is treated with a chelating agent and an acid to a pH range of about 1 to 4, and the pulp is then further delignified with ozone. Preferably, the ozone stage is conducted on high consistency pulp utilizing a dynamic reactor which turbulently mixes the pulp with the ozone gas so that substantially all pulp particles are exposed to the ozone gas for reaction therewith. This enables the pulp to be substantially uniformly bleached, thus forming an intermediate pulp.

The pulping/oxygen/ozone process taught by Griggs et al. produces intermediate pulps having a GE brightness of at least about 50%. For most papermaking purposes, however, a GE brightness in the range of 50 to 65% is unsatisfactory. In order to raise the GE brightness further to the more desirable levels of 90% or higher, the pulp is subjected to brightening bleaching, which is primarily intended to convert the chromophoric groups on the lignin remaining in the pulp into a colorless state.

Chlorine dioxide is generally highly effective both as a pulp brightness bleaching agent as well as a delignifying agent. As taught by Griggs et al., an appropriate amount of chlorine dioxide can be used, after an alkaline extraction of pulp ozonated in accordance with the inventive process described in the patent, to prepare high-strength pulp having a GE brightness value greater than 80%. Where, extremely high pulp brightnesses of about 92% GEB are desired, Griggs et al. teaches that additional extraction and chlorine dioxide treatments would be appropriate.

The Griggs et al. patent further teaches that hydrogen peroxide may be used instead of chlorine dioxide. When utilizing peroxides as the bleaching agent, however, the K Number of the pulp should be reduced to about 6 prior to the ozonation step in order to obtain a product having a GE brightness of greater that 80% following the peroxide bleaching stage, since peroxide is not as effective a bleaching agent as chlorine dioxide.

Cael, U.S. Pat. No. 4,404,061, teaches that persulfate, conveniently in the form of Oxone (which is defined hereinbelow), may be used to bleach Northern hardwood kraft pulp at 50° C., and that it may be used to pretreat Northern softwood chips prior to pulping them.

Hammann et al., "Bleaching of Kraft Pulp and ASAM Pulp without Chlorine Containing Chemicals", *Preprints from the International Pulp Bleaching Conference* 1991, Stockholm, Sweden, published by The Swedish Association of Pulp and Paper Engineers, 1991 (3) 185, discloses processes in which alkali-neutralized caroic acid (initial pH=10.3) is used in high temperature (70° C.) bleaching sequences on Kraft and ASAM pulps. Hammann et al. teach that this high temperature alkaline caroic acid bleaching stage allows sufficient pulp brightness after final bleaching without overly affecting the technological properties (i.e., strength) of the pulp. The measures of strength referred to in Hammann et al. are "breaking length" ("BL") and "tear strength" (TS). In Table 2a, an ozonation stage is reported to reduce Kraft pulp BL by 0.1 units and TS by 5.0 units; in the same table, caroic acid (applied at 70° C. and pH 10) lowers the BL and TS a further 0.05 and 2.4 units, respectively. In Table 3a, an oxygenation stage is reported to reduce Kraft pulp BL by 0.07 units and TS by 17.7 units; in the same table, caroic acid (applied at 70° C. and pH 10) lowers the BL and TS a further 0.58 and 1.4 units, respectively. Finally, in Table 4, an ozonation stage is reported to reduce ASAM pulp BL by 0.53 units and to raise TS by 13.5 units; in the same table, caroic acid (applied at 70° C. and pH 10, followed by alkaline extraction) lowers the BL and TS a 0.36 and 8.6 units, respectively. Caroic acid treatment, then, is taught to lower BL and TS from 0.05–0.58 units and 1.4–8.6 units, respectively; while oxygenation/ozonation are taught to lower BL from 0.07–0.53 units and to "lower" TS from 17.7–(−13.5) units. The point of this analysis of the Hammann et al. data is that the Hammann et al. actually tends to Suggest that caroic acid bleaching stages are comparable in their effect on the mechanical properties of pulp to oxygenation and ozonation stages. Of course, the Hammann et al. reference also teaches using caroic acid under rather demanding conditions.

Springer et al., U.S. Pat. No. 4,756,800, teach that pulp can be bleached by monoperoxysulfuric acid salts in an alkaline reaction mixture that comprises cupric ions. The patent teaches that good results are obtained when the pH is maintained at from about 12 to about 12.9.

Ragauskas et al., "Bleaching with Dimethyldioxirane", *Bleaching Fundamentals*, pp. 29–38, Non-Chlorine Bleaching Conference, Hilton Head, S.C., March 1993, teaches that Oxone may be reacted with acetone to produce dimethyldioxirane, which can be used to bleach pulp. The Ragauskas reference teaches that bleaching with dimethyldioxirane is best performed at a pH of 7, and that the bleaching reaction is most efficient at 80°C.

Meier et al., U.S. Pat. No. 5,091,054, teach that subsequent delignification and bleaching can be enhanced by pretreating lignocellulosic materials such as wood chips, kraft pulp, and the like with peroxymonosulfuric acid or its salts.

SUMMARY OF THE INVENTION

The present invention relates to a process for the manufacture of a bleached pulp having enhanced brightness which comprises subjecting a partially delignified pulp to the action of an inorganic peroxy acid salt at an initial pH which is just slightly alkaline and at ambient temperature for a period of time sufficient to increase the brightness of the partially delignified pulp. Thus, the present inventive processing step may be used in a process for the manufacture of a bleached pulp having enhanced brightness which comprises chemically digesting a lignocellulosic material to initially form a pulp and then partially delignifying said pulp in one or more stages that include the use of reagents such as oxygen, ozone, or hydrogen peroxide or, if desired, chlorine or chlorine dioxide, although the latter are less preferred. In such a process, the present inventive processing step will constitute the improvement which comprises subjecting the resulting partially delignified pulp in a subsequent process step to the action of an inorganic peroxy acid salt at an initial pH of about 7 to 9 for a period of time which is sufficient to increase the brightness of the partially delignified pulp to some useful degree, usually by about 5 GEB%. One aspect of the present invention contemplates carrying out the process without expending any energy to increase or maintain the temperature of the reaction environment. In some instances, however, it may be desired to treat pulp that has been heated to a high temperature for other purposes with an inorganic peroxy acid salt in accordance with the present invention. Since high temperature operation is detrimental to the present invention, positive cooling procedures may be employed if desired. The terminology "ambient temperature" as used herein refers to temperatures that would normally be found in a pulp bleaching mill, and in particular to the temperature of the pulp itself. In accordance with the present invention, such temperatures can range from extremes of around 20° C. to around 50° C.

The present inventive processing step is most advantageously used as the last stage of a multi-stage bleaching and brightening sequence. The present invention facilitates significant final brightening in such case without the strength loss which is usually associated with bleaching/brightening procedures. Thus, the process of the present invention comprises a novel brightening step which may be combined with known delignification and bleaching steps in order to eliminate problems encountered in the prior art by increasing the efficiency and reducing the cost and duration of pulp bleaching. The multi-stage preferred embodiments of the invention also eliminate the use of elemental chlorine and/or chlorine-containing bleaching agents, thus substantially reducing or eliminating pollution of the environment while optimizing the physical properties of the resultant pulp product in an energy efficient, cost effective manner. The present process is operable on virtually all wood species, including the difficult-to-bleach southern U.S. softwoods, as well as the more readily bleached hardwoods.

In practice, the present invention will generally involve a multi-stage procedure. The novel process step of the present invention will generally be used in a multi-step process that includes several stages, including a pulping stage, an oxygen delignification stage, and an ozone delignification/bleaching stage. Such stages together comprise what will be referred to herein as the bulk delignification portion of the process. In addition, the process may further comprise conventional brightening sequences that follow directly upon completion of ozone treatment. The process of the present invention provides pulp having GE brightness values comparable to those obtainable by more drastic treatments in the prior art without sacrificing pulp strength. The present process contemplates that lignin will be reduced as much as is practical in the delignification portion of the overall process (as evidenced by a corresponding decrease in the K No. of the pulp) without a concomitant substantial (and therefore unacceptable) decrease in pulp strength. This ensures that the strength of the pulp exiting the ozone delignification bleaching stage remains sufficiently high to permit the pulp to withstand the effects of the subsequent bleaching treatments, thus enabling the formation of a final bleached pulp product having sufficient strength and GE brightness ("GEB") for its intended application.

DESCRIPTION OF THE PREFERRED EMBODIMENTS

Figure 1:
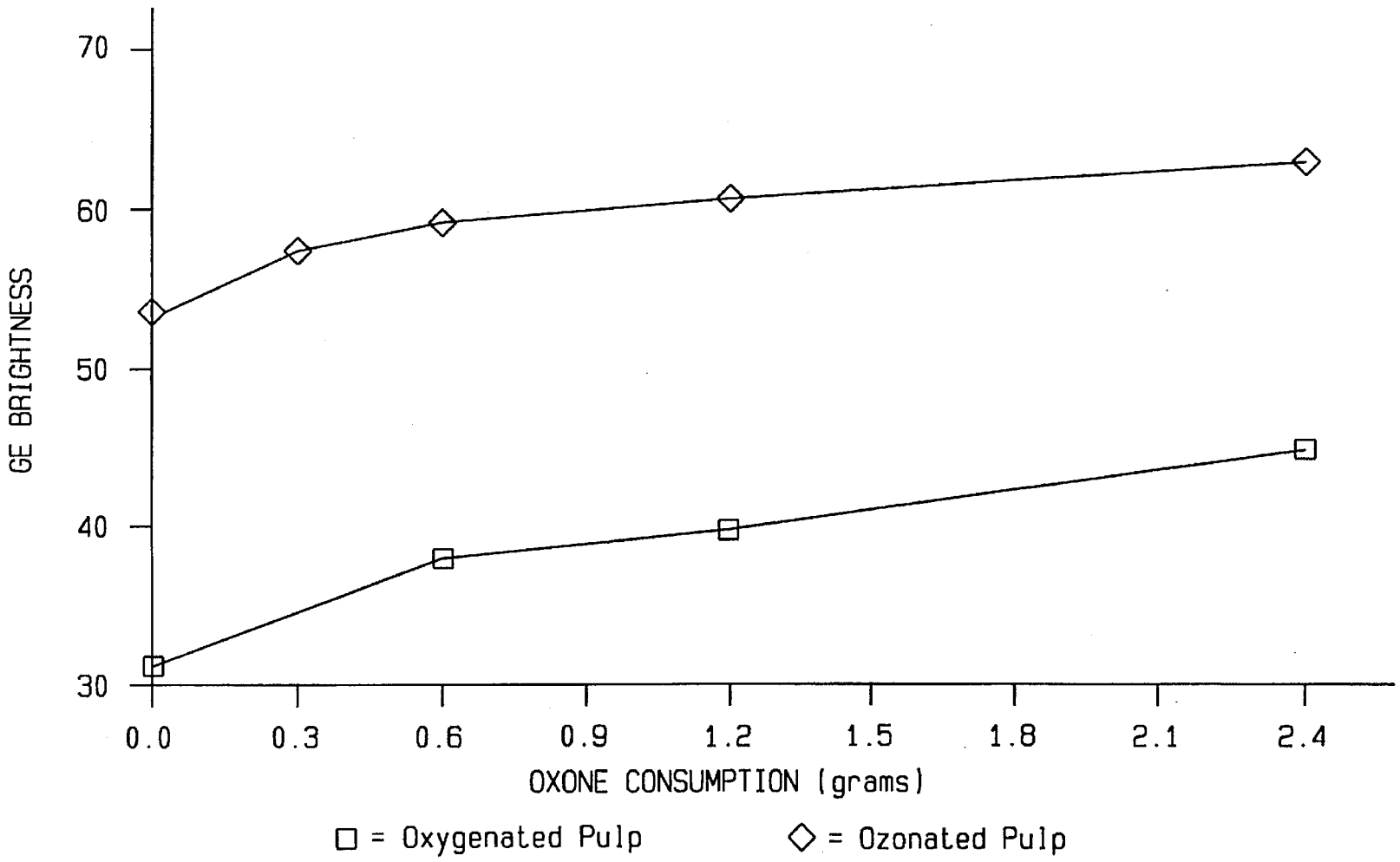
FIG. 1 is a graph of brightness versus applied inorganic peroxy acid salt for pulps which had been treated with intermediate bleaching stages as indicated.

It has been found that neutralized inorganic peroxy acids make ideal brightening agents for pulp that has previously undergone significant delignification and initial brightening procedures. While conceptually these inorganic peroxy acid salts could be used at any stage to bleach pulp, economics dictates that they be used in relatively small amounts after preliminary bleaching by less costly reagents. It has been found that the inorganic peroxy acid salts are ideal because, unexpectedly, they can be used under mild conditions to further brighten pulp that has already been brightened to a significant degree without substantial loss in pulp strength. Thus, the present invention may be advantageously used after double ozonation of oxygen-bleached softwood pulp. The second ozonation stage is normally conducted at about 120° F. After the second-stage ozonated pulp is washed with water, it will gradually and spontaneously cool over a period of time to a temperature that permits the contemplated brightness gain at no expense in viscosity. If it is desired to accelerate processing, however, the second-stage ozonated pulp may be cooled by the employment of conventional means such as further washing with cool water, agitation in the presence of high speed air streams, and so on.

A convenient group of peroxy acid salts for the purpose of the present invention are the alkali metal salts of peroxymonosulfuric acid, which acid is commonly known as caro's acid. OXONE is a commercially available product that is derived from KOH neutralization of a caro's acid mixture. It may be represented by the formula $$2KHSO_5 \cdot K_2SO_4 \cdot KHSO_4$$

OXONE contains approximately 49% potassium peroxymonosulfate per unit of charge. Other contemplated salts include ammonium peroxydisulfate, potassium peroxydisulfate, sodium peroxymonocarbonate, potassium peroxydicarbonate, salts of peroxymonophosphoric acid, potassium peroxydiphosphate, and the salts of Group IV, V, and VI peroxy acids, such as peroxytitanic acid, peroxydistannic acid, peroxydigermanic acid, and peroxychromic acid. For economic reasons, it is currently preferred to use the sodium analogue of OXONE in large scale applications.

In its broadest sense, the present invention contemplates a process for the manufacture of a bleached pulp having enhanced brightness which comprises subjecting a partially delignified pulp to the action of an inorganic peroxy acid salt at an initial pH which is just slightly alkaline and at ambient temperature for a period of time sufficient to increase the brightness of said partially delignified pulp. One advantage of the present invention is that it may be carried out where the ambient temperature is approximately 25° C. However, in a bleach plant, ambient temperature may be well in excess of this temperature. Conducting the process at temperatures that are somewhat elevated may even, in some circumstances, be advantageous. However, it will generally not be necessary to expend additional energy to heat the reactants when practicing the present invention.

Thus, the present inventive processing step may be used in a process for the manufacture of a bleached pulp having enhanced brightness which comprises chemically digesting a lignocellulosic material to initially form a pulp and then partially delignifying said pulp in one or more stages by means of process steps that include the use of reagents selected from the class consisting of chlorine, chlorine dioxide, oxygen, ozone, or hydrogen peroxide. In such a process, the present inventive processing step will constitute the improvement which comprises subjecting the resulting partially delignified pulp in a subsequent process step to the action of an inorganic peroxy acid salt at an initial pH of about 7 and preferably between 7 and 9 without expending any energy to increase or maintain the temperature of the reaction environment for a period of time which is sufficient to increase the brightness of the partially delignified pulp to some useful degree, usually by about 5 to 15 GEB %.

The present inventive processing step is most advantageously used as the last stage of a multi-stage bleaching and brightening sequence. The present invention facilitates significant final brightening in such case without the strength loss which is usually associated with bleaching/brightening procedures. A typical process for the manufacture of a bleached pulp having a certain brightness and a certain strength as indicated by a certain viscosity would include the following steps:

chemically digesting a lignocellulosic material to initially form a pulp;

oxygen delignifying the pulp to remove a substantial portion of the lignin therefrom, with the combination of the digesting and oxygen delignifying steps being conducted to form an intermediate pulp having a specified amount of lignin and a specified viscosity;

ozone delignifying the intermediate pulp with a gaseous mixture that contains ozone to remove a substantial portion, but not all, of the remaining lignin to form a delignified pulp having a reduced amount of lignin and the certain strength, viscosity and brightness; wherein the specified amount of lignin of the intermediate pulp is such that, after ozone delignification, the delignified pulp attains the certain GE brightness, and wherein the specified viscosity of the intermediate pulp is sufficiently high to permit the delignified pulp, after ozone delignification, to attain the certain strength as evidenced by the certain viscosity; and increasing the certain brightness of the delignified pulp by subjecting the pulp to a brightening sequence. The brightening sequence can include treating the delignified pulp with a peroxide compound under conditions sufficient to raise the certain brightness of the pulp to a first increased brightness which is higher than the certain brightness; then treating the pulp with ozone under conditions sufficient to raise the first increased brightness of the pulp to a second increased brightness which is higher than the first increased brightness; and subsequently treating the pulp with the salt of an inorganic peroxy acid at ambient temperature and an initial pH of about 7.5 for a period of time sufficient to raise the second increased brightness to a third increased brightness which is higher than the second increased brightness.

For convenience in referring to the process steps, the following designations will be used herein:

| Term | Description |
|---|---|
| E Alkaline extraction | Dissolution of reaction products with NaOH |
| P Peroxide | Reaction with peroxide in alkaline medium |
| Q Chelation | Reaction with polyvalent metal complexes |
| O Oxygen | Reaction with elemental oxygen in alkaline medium |
| Z Ozone | Reaction with ozone |
| A inorganic peroxy acid salt | Reaction with inorganic peroxy acid salt, in accordance with the present invention |

The present invention may be carried out in batch or continuous processes. The first stage in the overall OZEPZA method which is one variation of the present invention is the pulping step. Wood chips are introduced into a digester together with a white liquor comprising sodium hydroxide, sodium sulfide and optionally an anthraquinone additive. Sufficient white liquor should be introduced into digester to substantially cover the wood chips. The contents of digester are then heated at a temperature and for a time sufficient to allow the liquor to substantially impregnate the wood chips. The use of the Kraft/AQ pulping technique is preferred since the inclusion of the anthraquinone additive contributes significantly to the degree of lignin removal without causing significant adverse affects upon the desired strength characteristics of the remaining cellulose. Alternately, or perhaps even in addition to the use of the Kraft/AQ process, the pulping stage can be carried out with the use of techniques for extended delignification such as the Kamyr MCC and EMCC or isothermal cooking, Beloit RDH and Sunds Superbatch methods. These techniques also offer the ability to remove more of the lignin during cooking without adversely affecting the desired strength characteristics of the remaining cellulose to a significant degree.

The digester produces a black liquor containing the reaction products of wood solubilization together with the brownstock pulp. The cooking step is typically followed by washing to remove most of the dissolved organics and cooking chemicals for recycle and recovery, as well as a screening stage in which the pulp is passed through a screening apparatus to remove bundles of fibers that have not been separated in pulping.

The pulping step may be conducted so that, for a southern U.S. softwood, for example, conventional Kraft pulp with a K No. in the range of about 20–24 (target of 21), a CED viscosity in the range of about 21–28, and a GE brightness in the range of about 15–25 is typically obtained. For southern U.S. hardwood, conventional Kraft pulp with a K No. in the range of about 10–14 (target 12.5) and a CED viscosity of about 21–28 may typically be obtained. It is often advantageous, however, to omit extended delignification procedures.

The next stage in the process of the present invention, i.e., the oxygen delignification step or "O" step, primarily involves removal of part of the residual lignin from the brownstock pulp. Those skilled in the art are familiar with oxygen delignification procedures that involve high, medium, and low consistency pulps.

In accordance with conventional high consistency oxygen delignification techniques, the washed pulp is pressed to a high consistency of at least about 25% and an aqueous alkaline solution is then sprayed onto the resultant fiber mat. The high consistency alkaline fiber mat is then subjected to oxygen delignification to remove a substantial portion of the lignin from the pulp. When used to obtain substantial decreases in K No., i.e., greater than 50%, this procedure is known to cause substantial decreases in pulp viscosity, i.e., strength. Thus, it is important to couple this technique with one of the more efficient pulping processes, such as Kraft/AQ and/or extended delignification, in order to obtain pulp with sufficiently low K Nos. for use in the remainder of the present preferred bleaching process. Generally, the preferred oxygen delignification step comprises forming a low to medium consistency pulp; treating the low to medium consistency pulp with an aqueous solution of an alkaline material for a predetermined time and at a predetermined temperature relative to the quantity of the alkaline material to substantially uniformly distribute the alkaline material throughout the low to medium consistency pulp; raising the consistency of the pulp to a high consistency; and subjecting the resulting high consistency pulp to high consistency oxygen delignification to obtain the intermediate pulp. Alternatively, peracid bleaching in accordance with the present invention may be carried out on pulp that has never been raised to high consistency.

After oxygen delignification, the partially delignified pulp is forwarded to washing unit wherein the pulp is washed with water to remove any dissolved organics and to produce high quality, low color pulp. Upon completing the oxygen delignification stage, the delignification selectivity of the pulp is enhanced in that the K No. of the pulp is decreased by at least about 50%, compared to the decrease of no more than about 50% with conventional oxygen delignification systems, without significantly damaging the cellulose component of the pulp. The GEB brightness of the pulp after this stage is generally between about 35 and 50 depending upon the type of pulp and the specific pulping conditions utilized. For the softwood pulp described above, a K No. of about 7–10 and a viscosity of above about 13 is readily achieved. For hardwood pulp, a K No. of about 5–8 and a viscosity above about 13 is obtained after the oxygen delignification step.

The next step in the overall process of the invention may involve ozone delignification and bleaching of the oxygen-delignified brownstock pulp ("Z"). One or more ozonation stages may be used. Treating pulp at high consistencies with ozone without paying particular attention to the comminution of the pulp fibers or to the contact between the individual fibers and the reactant gas stream invariably results in a non-uniform ozone bleaching of the fibers. However, it is preferred to use a modified ozone technique in which the fibers in a desired size range are uniformly contacted with the ozone gas stream.

Prior to treatment with ozone, the pulp is conditioned so as to ensure the most effective selective delignification and to minimize the chemical attack of the ozone on the cellulose. The incoming pulp is directed into a mixing chest, where it is diluted to a low consistency. An organic or inorganic acid such as sulfuric acid, formic acid, acetic acid or the like, is added to the low consistency pulp to decrease the pH of the pulp in mixing chest to the range of about 1 to 4 and preferably between 2 and 3. The acidified pulp is treated with chelating agent to complex any metals or metal salts which may be present therein. This chelating step is used to render such metals non-reactive or harmless in the ozone reactor so that they will not cause breakdown of the ozone, thus decreasing the efficiency of the lignin removal and also reducing the viscosity of the cellulose. Preferred chelating agents for this ozone treatment, for reasons of cost and efficiency, include diethylenetriamine pentacetic acid, ethylenediamine tetraacetic acid, and oxalic acid. Amounts of these chelating agents ranging from about 0.1% to about 0.2% by weight of OD pulp are generally effective, although additional amounts may be needed when high metal ion concentrations are present.

The acidified, chelated, low-consistency pulp is introduced into a thickening unit, such as a twin roll press, for removing excess liquid from the pulp, wherein the consistency of the pulp is raised to a level which will generally be well above 20%. At least a portion of this excess liquid may be recycled to mixing chest with a remaining portion being directed to the plant recovery. The resultant high consistency pulp is then passed through compaction device such as a screw feeder which acts as a gas seal for the ozone gas and thereafter through a comminuting unit, such as a fluffer, for use in reducing the pulp particle size as described below. A preferred range of consistency, especially for southern U.S. softwood, has been reported by Griggs et al. to be between about 28% and 50%, with the optimum results being obtained at between about 38% and 45% prior to contact with ozone. Within the above ranges, preferred results are obtained as indicated by the relative amount of delignification, the relatively low amount of degradation of the cellulose, and the noticeable increase in the brightness of the treated pulps.

The reaction temperature at which the ozone bleaching is conducted is likewise an important factor. The maximum temperature of the pulp at which the reaction should be conducted should not exceed the temperature at which excessive degradation of the cellulose occurs, which with southern U.S. softwood is a maximum of about 120° F. to 150° F.

During the ozone bleaching process, the particles to be bleached should be exposed to the gaseous ozone bleaching agent by mixing so as to allow access of the ozone gas mixture to all surfaces of the flocs and equal access by the ozone gas mixture to all flocs. A preferred apparatus comprises a paddle reactor as described in U.S. Pat. No. 5,181,989, the disclosure of which is expressly incorporated herein by reference thereto.

It is preferred for the ozone delignification of the pulp to be carried out by dispersing the pulp substantially completely throughout the reaction zone while simultaneously conveying the pulp through the reaction zone in a plug flow-like manner at a dispersion index of about 7 or less thus exposing substantially all of the pulp to the ozone for reaction therewith. Also, the ozone delignification of the intermediate pulp can be carried out by:

- introducing the high consistency pulp into the reaction zone at a fill level of at least about 10%;
- introducing the ozone containing gaseous mixture into the reaction zone for contact with the pulp; and
- intimately contacting and mixing the pulp with the ozone by lifting, displacing and tossing the pulp in a radial direction to disperse the pulp and expose substantially all of the pulp to the gaseous bleaching agent while advancing the dispersed pulp axially through the reactor in a plug-flow like manner and at a dispersion index of below about 7 for a predetermined time to obtain substantially uniform bleaching of the pulp and to form a bleached pulp having the certain GE brightness, certain strength and certain viscosity.

If desired, the consistency of the intermediate pulp can be increased to at least about 28% before comminuting the increased consistency pulp into discrete particles of a predetermined particle size having a sufficiently small diameter and a sufficiently low density to facilitate substantially complete penetration of a majority of the pulp particles by ozone gas without causing significant degradation of the cellulose components of the pulp. In addition, it is possible to maintain a substantially constant and predetermined fill level of said pulp particles in the reaction zone by initially advancing said relatively low bulk density pulp particles at a first rate thus increasing the low bulk density, and advancing said increased bulk density particles at a second rate less than said first rate.

The ozone gas which is used in the bleaching process may be employed as a mixture of ozone with oxygen and/or an inert gas, or it can be employed as a mixture of ozone with air. The amount of ozone which can satisfactorily be incorporated into the treatment gases is limited by the stability of the ozone in the gas mixture. Conventional ozone gas mixtures which now typically contain about 1–14% by weight of ozone in an ozone/oxygen mixture, or about 1–7% ozone in an ozone/air mixture, are suitable for use in this invention. A further description and discussion of the reaction conditions utilized in the ozone delignification stage of the invention can be found in Griggs et al. U.S. Pat. Nos. 5,164,043 and 5,164,044, the disclosure of each of which is expressly incorporated herein by reference thereto.

Pulp fiber flocs, after treatment, are directed into tank by spray from water nozzles which create a water shower that soaks the pulp and quenches the ozone bleaching reaction on the pulp particles. It is desirable that the quenching occur as uniformly and as quickly as possible in order to preserve the bleaching uniformity achieved in the reactor apparatus. Thus, these nozzles are arranged to provide an even, soaking shower of water while also being angled downward at an angle of at least 30° with respect to the horizontal and preferably at about 45°, in order to force the pulp down into the tank and avoid the formation of a water curtain which would inhibit the free fall of the pulp. The pulp collected in tank has a consistency of about 6% and is washed and recovered or transported to subsequent brightening treatments.

Pulp exiting the ozone reactor has a GE brightness of at least about 48 percent and generally around 50 to 80 percent, with hardwoods usually being above about 60 percent. The pulp (for hardwoods or softwoods) also has a K No. of between about 3 and 6.

For certain papermaking processes, a final pulp brightness in the upper end of this range is satisfactory. When it is necessary to further raise the pulp brightness to higher GEB values, the substantially delignified pulp from the $Z_m$ stage is subsequently subjected to the brightening sequence, which is primarily intended to remove most or all of the remaining lignin and convert any remaining chromophoric groups on the lignin in the pulp into colorless derivatives.

In order to obtain further brightening, an extraction stage (i.e., "E") prior to such further brightening may be conducted. If an extraction stage is used or desired, it may be conducted as described in the aforementioned '043 and '044 patents, i.e., by mixing the pulp with an alkaline material to solubilize a substantial portion of the lignin which remains in the pulp. The E stage can be augmented with either oxygen, peroxide or oxygen and peroxide, if desired. It is also possible and advantageous to include an additive to prevent loss of viscosity during such extractive treatments. One well known additive for this purpose is sodium borohydride. Further information about these additives can be found in an article by Lindholm, "Alkaline Extraction of Ozone-Bleached Pulp," Journal of Pulp and Paper Science, Vol. 19, No. 3, May, 1993, which summarizes the effects and benefits of such additives in various extraction processes. In addition, additives such as formamidine sulfinic acid or sodium hydrosulfite can instead be used for the same purposes. When such additives are used, the extraction is referred to as a reduction stage.

One advantageous way to conduct extractions is to add an alkaline material such as sodium hydroxide to the water in the tank. As with any extraction stage, the addition of alkaline material decreases the amount of oxidant required in the subsequent bleaching sequence, and the cost of alkaline material is less than the cost of the subsequently used brightening agents. The alkaline material is added in an amount sufficient to raise the pH of the pulp to between about 7 to 8, since these higher values are necessary when a peroxide compound is used for further brightening of the pulp.

After completion of the ozone bleaching step and the extraction step, the substantially delignified pulp is again thoroughly washed. The washed pulp has a pH near neutral and a consistency of about 16%.

The pulp is first conditioned in a tank where a chelating is added with water to sequester undesirable metal ions which could cause decomposition of the peroxide brightening agent. The consistency of the pulp is reduced to about 3–12% and the pH remains at about 7 to 8 while the pulp is held at about 90° C. for about 1 hour. The need for this treatment is dependent on the metal ion type, its amount in the pulp and its accompanying dissolved solids. The pulp which exits the chelating tank is thoroughly washed in a washer to remove the chelants and any sequestered metal ions. The washed pulp again has a pH near neutral and a consistency of about 16%. The wash water for this washer would generally be fresh water.

The washed pulp then is directed into a peroxide brightening tower where a solution of alkaline material and a peroxide compound, such as hydrogen peroxide, is added. This adjusts the consistency of the pulp to a range of between about 8–35%, while the pH of the pulp is adjusted upwardly to ensure a final pH of about 9.5 to 11. A peroxide stabilizing agent, selected from sodium silicate, magnesium sulfate, a chelating agent, or mixtures thereof, can be added in an amount sufficient to prevent the undesirable decomposition of the hydrogen peroxide bleaching agent. The stabilizing agents are added on a weight percent basis based upon the weight of the pulp, with preferred ranges of use being up to 3% of sodium silicate, up to 0.2% magnesium sulfate, i.e., as magnesium ($Mg^{++}$) and up to 0.2% of the chelate. The preferred stabilizing agent is magnesium sulfate.

The solution to be added will generally include between about 0.25 and 4% by weight of a hydrogen peroxide solution, preferably hydrogen the weight based upon the weight of the pulp. When hardwoods or other relatively easy to bleach woods are utilized, the peroxide treatment can be conducted by contacting the pulp with lesser amounts of the chemical within this range, while softwoods would require greater amounts of chemical which would typically be about 0.75 to 1%. The reaction is conducted in a brightening tower for sufficient time to increase the brightness of the pulp to the desired levels. Generally, a GE brightness of about 67 to 88 and preferably above about 75–80 GEB is attained. The brightness value achieved will depend upon the amounts of chemical used and the brightness of the pulp as it enters into the peroxide brightening stage.

The pulp which exits the tower is again thoroughly washed in a washer using recycle water or fresh water. The washed pulp again has a pH near neutral and a consistency of about 16%.

Where higher brightness values are desired for the final pulp, as in accordance with the present invention, an ozone stage may be conducted after the peroxide treatment. Unlike the initial ozone stage, which conducts bulk delignification on high consistency pulp using a specially designed reactor for turbulently mixing the pulp and the ozone gas bleaching agent in order to obtain uniform bleaching, the second ozone stage utilizes a much lower amount of ozone chemical with a high shear mixing device to achieve substantial brightness increases and to activate the pulp previously treated with peroxide to achieve enhanced response in a second peroxide stage, if one is employed. This second ozone stage applies a relatively small amount of between about 0.01 and 0.5% by weight ozone based on the weight of OD pulp to obtain a relatively large increase in brightness to between about 78 and 90 GEB, and preferably above about 85 GEB.

Pulp exiting the peroxide treatment would be directed into a chest or mixing tank where the pulp can be combined with the appropriate chelation agents and acids to form an acidic chelated low to medium consistency pulp. The particular consistency of the pulp can be between about 1 and 18% with between about 1–5% used for low consistency and between about 6 and 18% used for medium consistency, with one of ordinary skill in the art being capable of selecting the particular consistency for the desired final pulp. An ozone gas mixed with water is also added to the tank. The concentration of the ozone gas in the high shear mixer is adjusted so that an application of about 0.01 to 0.5%, and preferably between about 0.04 and 0.3% by weight based on the O.D. weight of the pulp is applied. The pH of the pulp will be less than about 7 and preferably about 4 or less.

The acidic chelated low to medium consistency pulp is then directed into a high shear MC mixer as disclosed in U.S. Pat. No. 5,145,557, the content of which is expressly incorporated herein by reference thereto. Thus, the ozone and pulp are substantially uniformly combined so that the ozone has access to all pulp particles for reaction therewith. Since the ozone-pulp reaction is very rapid, the pulp contact with ozone gas in the mixer is sufficient to brighten the pulp to the desired values. As noted above, a typical GEB after this stage would be about 85 or greater.

After the pulp is treated with ozone in the high shear mixer, the pulp is directed to a residence tower where the ozone-pulp reaction can continue. Spent gas exits the tower and can be recycled with the other spent gas from the previous reactor to the carrier gas pretreatment stage. The ozone treated pulp is thoroughly washed in a washer. It has also been found that the ozone brightening step activates the pulp, thus making it more receptive to bleaching by the subsequent brightening stage. A solution of alkaline material is used as the wash water so that the washed pulp will have a pH near neutral and a consistency of about 16%. The wash water effluent can be recycled as for washing the pulp after any of the previous delignification stages.

For certain woods, such as the difficult to bleach softwoods, it is often desirable to conduct a further brightening stage to achieve the final desired brightness of the pulp. Thus, an inorganic peroxy acid salt brightening stage in accordance with the present invention can be advantageously conducted. It is anticipated that this stage would be conducted utilizing approximately one-half the amount of chemical that is used in the peroxide stage described above, i.e., about 0.1 to 1, preferably about 0.1 to 0.6 and most preferably about 0.3 to 0.4%.

Pulp that has been heated and washed as described above can be used without positive cooling. However, if the pulp has not cooled sufficiently, increased strength loss, as evidenced by decrease in viscosity, may be experienced.

In a preferred embodiment, the washed pulp is directed into a peroxy acid salt brightening tower, where a solution of alkaline material and a composition containing an inorganic peroxy acid salt, such as OXONE, is added. This adjusts the consistency of the pulp to a range of between about 10–15%, while the pH of the pulp is adjusted to ensure an initial pH of about 7.25. A peroxide stabilizing agent, selected from sodium silicate, magnesium sulfate, a chelant (such as EDTA or DTPA) or mixtures thereof, can be added in an amount sufficient to prevent the undesirable decomposition of the hydrogen peroxide bleaching agent. The preferred stabilizing agent is magnesium sulfate. The stabilizing agents are added on a weight percent basis based upon the weight of the pulp. Lesser amounts of these agents are used compared to the peroxide stage described above, with preferred ranges of use being up to 1.5% of sodium silicate, up to 0.1% magnesium sulfate, i.e., as magnesium ($Mg^{++}$) and up to 0.1% of the chelant. Also, use of these additives may not be necessary since the condition of the pulp is relatively clean at this point in the process.

The solution to be added will generally include between about 0.1 and 1% by weight of the inorganic peroxy acid salt based upon the weight of the pulp. When hardwoods or other relatively easy to bleach woods are utilized, the peroxide treatment can be conducted by contacting the pulp with amounts of the chemical on the lower end of this range, while softwoods would require greater amounts of chemical which would typically be about 0.3 to 0.5%. The reaction is conducted in a brightening tower for sufficient time to increase the brightness of the pulp to the desired levels. Generally, a GE brightness of about 85 to 93 and preferably above about 90 GEB is attained. The brightness value achieved will depend upon the amounts of chemical used and the brightness of the pulp as it enters into this second peroxide brightening stage.

Preferably, the peroxy acid salt step is conducted on pulp having a consistency of about 8 to 35%. The specific peroxide compound to be used, which is generally hydrogen peroxide, as well as the particular stabilizer combinations are considered to be conventional and well within the knowledge of one skilled in the art.

The pulp which exits tower is again thoroughly washed in a washer using fresh water. The washed pulp again has a pH near neutral and a consistency of about 16%. The wash water effluent from this washer can be used to advantage as the washing water for the previous washer step.

The resultant pulp is fully bleached and brightened to GEB values typically of at least about 85 to as high as 93, thus rendering the final product suitable for use as a pulp for making high quality white paper.

Other post treatments to stabilize the final brightness, such as $SO_2$ souring can be employed. The use of such materials is well known to those of ordinary skill in the art and need not be explained in any greater detail here.

EXAMPLES

The scope of the invention is further described in connection with the following Examples which are set forth for purposes of illustration only and which are not to be construed as limiting the scope of the invention in any manner. Unless otherwise indicated, all chemical percentages are calculated on the basis of the weight of OD pulp. Also, one skilled in the art would understand that the target brightness values do not need to be precisely achieved, as GEB values of plus or minus 2% from the target are acceptable.

In the following Examples, the following procedures were used to determine:

GE Brightness

This parameter is a measure of reflectivity, and is expressed as a percentage of a maximum GE brightness as determined by TAPPI Standard Method TPD-103.

K Number

This is a measure of the degree of delignification, and is the number of cubic centimeters of tenth normal potassium permanganate solution consumed by one gram of oven dried pulp under specified conditions. It is determined by TAPPI Standard Test T-214.

Viscosity

The viscosity of a bleached pulp is representative of the degree of polymerization of the cellulose in the bleached pulp and as such is representative of the strength of the pulp. On the other hand, K Number represents the amount of lignin remaining in the pulp. Accordingly, an oxygen delignification reaction that has a high selectivity produces a bleached pulp of high strength (i.e., high viscosity) and low lignin content (i.e., low K Number).

Examples 1–4 Oxidation of Oxygen-Bleached Pine Pulp

Fifteen grams of oven-dry pulp that had been bleached with gaseous oxygen and 55 milliliters of water were charged into each of 4 separate containers. The pulp had a GE Brightness of 31.1, a viscosity of 18.3 cps, and a 25 mL K Number of 8.92. Separately, Oxone, sodium bicarbonate, and 80 milliliters of water were charged into 4 separate containers in the amounts shown in Table 1.

Each batch of chemicals was mixed vigorously for five minutes, then added to the pulp suspension. The suspension with the chemicals added was then kneaded well in order to achieve initial distribution of the chemicals, and was kneaded intermittently over the course of one hour to ensure complete reaction. The initial pH was adjusted to 7.5 and the reaction carried out at 25° C. The pulps were washed well and tested to determine GE Brightness, K-Number, and viscosity in accordance with the procedures indicated above. The results are indicated in Table 1.

TABLE 1

| Example No. | 1 | 2 | 3 | 4 |
|---|---|---|---|---|
| OXONE (grams) | 0.3 | 0.6 | 1.2 | 2.4 |
| $NaHCO_3$ (grams) | 0.3 | 0.6 | 1.2 | 2.4 |
| GEB | — | 37.9 | 39.7 | 44.8 |
| Visc.(cps) | 19.0 | 18.7 | 18.5 | 18.7 |
| $K_{25}$ | 7.5 | 7.5 | 6.7 | 5.8 |
| Change in GEB | — | 6.8 | 8.6 | 13.7 |
| Change in Visc. | 0.7 | 0.4 | 0.3 | 0.4 |
| Change in $K_{25}$ | −1.38 | −1.44 | −2.20 | −3.17 |

Figure 2:
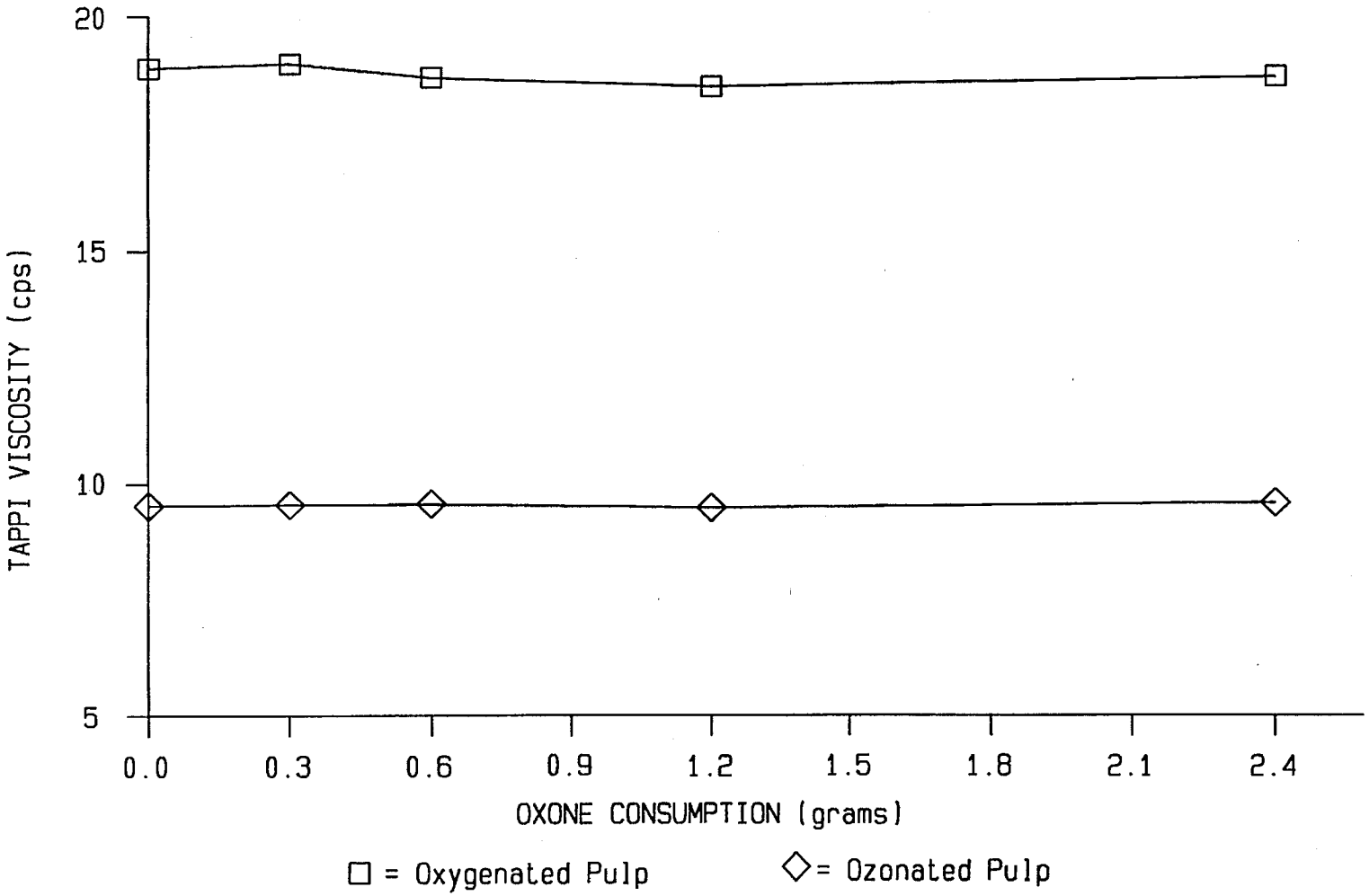
FIG. 2 is a graph of viscosity versus applied inorganic peroxy acid salt for pulps which had been treated with intermediate bleaching stages as indicated.

As the data in Table 1 indicates, pulp brightness increases proportionally to increases in concentration of potassium peroxymonosulfate (in an Oxone formulation), with a GEB increase of 13.7 points at an OXONE level of 2.4 grams for 15 grams of pulp having an initial GEB of 31.1. This is illustrated graphically in FIG. 1. As illustrated in FIG. 2, pulp viscosity changes were negligible, even at the highest level of OXONE studied.

Examples 5–8: Oxidation of Ozone-Bleached Pine Pulp

Fifteen grams of oven-dry pulp that had been bleached with gaseous ozone and 55 milliliters of water were charged into each of 4 separate containers. The pulp had a GE Brightness of 53.6, a viscosity of 9.53 cp, and a 25 mL K Number of 3.85. Separately, OXONE, sodium bicarbonate, and 80 milliliters of water were charged into 4 separate containers in the amounts shown in Table 2.

Each batch of chemicals was mixed vigorously for five minutes, then added to the pulp suspension. The suspension with the chemicals added was then kneaded well in order to achieve initial distribution of the chemicals, and was kneaded intermittently over the course of one hour to ensure complete reaction. The initial pH was adjusted to 7.5 and the reaction carried out at 25° C. The pulps were washed well and tested to determine GE Brightness, K-Number, and viscosity in accordance with the procedures indicated above. The results are indicated in Table 2.

TABLE 2

| Example No. | 5 | 6 | 7 | 8 |
|---|---|---|---|---|
| OXONE (grams) | 0.3 | 0.6 | 1.2 | 2.4 |
| $NaHCO_3$ (grams) | 0.3 | 0.6 | 1.2 | 2.4 |
| GEB | 57.4 | 59.1 | 60.6 | 63.1 |
| Visc.(cp) | 9.55 | 9.56 | 9.48 | 9.59 |
| $K_{25}$ | 3.85 | 3.43 | 3.15 | 2.82 |
| Change in GEB | 3.8 | 5.5 | 7.0 | 9.5 |
| Change in Visc. | 0.02 | 0.03 | −.05 | 0.06 |
| Change in $K_{25}$ | 0 | −.42 | −.70 | −1.03 |

As the data in Table 2 indicates, pulp brightness increases proportionally to increases in concentration of potassium peroxymonosulfate (in an Oxone formulation), with a GEB increase of 9.5 points at an Oxone level of 2.4 grams for 15 grams of pulp having an initial GEB of 53.6. This is illustrated graphically in FIG. 1. As illustrated in FIG. 2, pulp viscosity changes were negligible, even at the highest level of Oxone studied.

Examples 9–26: Effect of Reaction Time and Concentration

The inorganic peroxide bleaching stages of Examples 1–8 were all one hour in duration. The impact of reaction time on inorganic peroxide bleaching was assessed on a sample of kraft/OZ pine pulp having the following properties: 61.5 GEB, 10.26 cps viscosity, and 2.53 K-Number. A pulp of intermediate brightness was used so as to more clearly define the impact of reaction time. Reaction conditions were as follows: 10% consistency, initial pH 7.5, initial temperature 25° C., sodium bicarbonate at same level as active oxygen. Tables 3–5 summarizes the bleaching results obtained from bleaching this pulp across the reaction time range of 1 to 100 minutes, at i.e., 0.25, 0.50, 0.75, of application of the inorganic peroxide to the pulp.

TABLE 3

| Example No. | 9 | 10 | 11 | 12 | 13 | 14 |
|---|---|---|---|---|---|---|
| Time (minutes) | 1 | 3 | 8 | 15 | 40 | 100 |
| OXONE (% on pulp) | 0.25 | 0.25 | 0.25 | 0.25 | 0.25 | 0.25 |
| $NaHCO_3$ (% on pulp) | 0.25 | 0.25 | 0.25 | 0.25 | 0.25 | 0.25 |
| GEB | 62.5 | 63.2 | 64.9 | 65.1 | 67.0 | 69.6 |
| Visc.(cps) | 10.79 | 10.58 | 11.26 | 10.55 | 10.92 | 11.07 |
| $K_{25}$ | 2.15 | 2.25 | 1.90 | 2.15 | 1.35 | 1.65 |
| Change in GEB | 1.0 | 1.7 | 3.4 | 3.6 | 5.5 | 8.1 |
| Change in Visc. | 0.53 | 0.32 | 1.0 | 0.29 | 0.66 | 0.81 |
| Change in $K_{25}$ | −.38 | −.28 | −.63 | −.38 | −1.18 | −.88 |

TABLE 4

| Example No. | 15 | 16 | 17 | 18 | 19 | 20 |
|---|---|---|---|---|---|---|
| Time (minutes) | 1 | 3 | 8 | 15 | 40 | 100 |
| OXONE (% on pulp) | 0.50 | 0.50 | 0.50 | 0.50 | 0.50 | 0.50 |
| $NaHCO_3$ (% on pulp) | 0.50 | 0.50 | 0.50 | 0.50 | 0.50 | 0.50 |
| GEB | 64.9 | 66.5 | 68.3 | 68.6 | 69.5 | 73.2 |
| Visc.(cps) | 10.93 | 10.73 | 10.84 | 10.97 | 11.12 | 11.23 |
| $K_{25}$ | 1.63 | 1.60 | 1.60 | 1.47 | 1.55 | 1.20 |
| Change in GEB | 3.4 | 5.0 | 6.8 | 7.1 | 8.0 | 11.7 |
| Change in Visc. | 0.67 | 0.47 | 0.58 | 0.71 | 0.86 | 0.97 |
| Change in $K_{25}$ | −.90 | −.93 | −.93 | −1.06 | −.98 | −1.33 |

TABLE 5

| Example No. | 21 | 22 | 23 | 24 | 25 | 26 |
|---|---|---|---|---|---|---|
| Time (minutes) | 1 | 3 | 8 | 15 | 40 | 100 |
| OXONE (% on pulp) | 0.75 | 0.75 | 0.75 | 0.75 | 0.75 | 0.75 |
| $NaHCO_3$ (% on pulp) | 0.75 | 0.75 | 0.75 | 0.75 | 0.75 | 0.75 |
| GEB | 66.5 | — | 69.2 | 70.9 | — | 75.4 |
| Visc.(cps) | 10.91 | 11.07 | 10.70 | 11.22 | 10.26 | 11.11 |
| $K_{25}$ | 1.80 | — | 1.42 | 1.10 | — | 0.85 |
| Change in GEB | 5.0 | — | 7.7 | 9.4 | — | 13.9 |
| Change in Visc. | 0.65 | 0.81 | 0.49 | 0.96 | 0 | 0.85 |
| Change in $K_{25}$ | −.73 | — | −1.11 | −1.43 | — | −1.68 |

Figure 3:
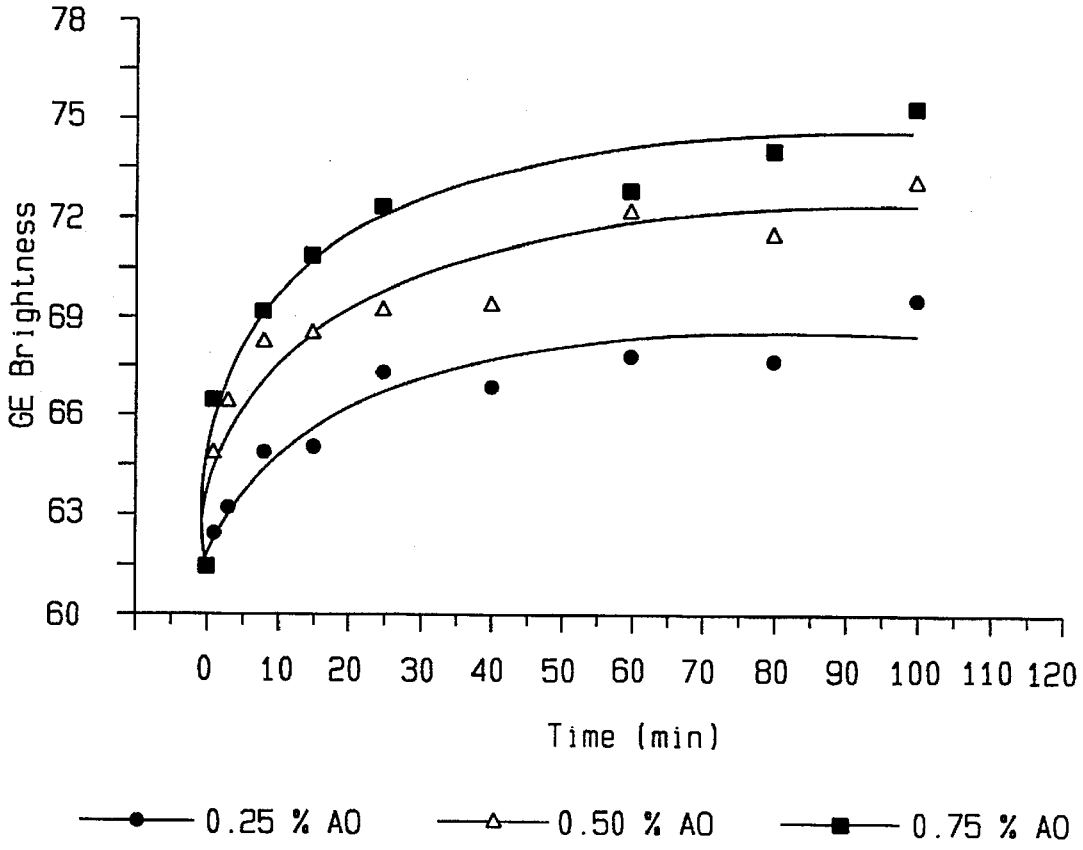
FIG. 3 is a plot of GE brightness versus time for three different concentration levels of OXONE.

The results reported in Tables 3–5 show pulp viscosity increases as well as significant brightness increases following OXONE bleaching of kraft/OZ pulp. The brightness results shown in Tables 3–5 are further analyzed in FIG. 3 in the plot of GE brightness versus reaction time. There is a phase of rapid brightness increase followed by a more gradual increase to the ceiling brightness level. The concentration dependence of OXONE bleaching may also be seen from FIG. 3. There is a strong dependence of brightness increase on the concentration of active oxygen, ranging from 0.28 to 0.84 g/L. The initial rate of brightness increase is also greater at higher concentrations of active oxygen on pulp. Even at the high application of 0.75% active oxygen on pulp at long reaction times, pulp viscosities greater than that of the starting pulp were recorded. A brightness gain of 13.9 points and a viscosity gain of 0.85 centipoise is obtained following OXONE bleaching for 100 minutes with an active oxygen application of 0.75% on pulp.

Examples 27–32: Effect of Reaction Temperature

The impact of reaction temperature on inorganic peroxide bleaching was assessed on a sample of kraft/OZ pine pulp having the following properties: 61.5 GEB, 10.26 cps viscosity, and 2.53 K-Number. A pulp of intermediate brightness was used so as to more clearly define the impact of reaction temperature. Reaction conditions were as follows:

10% consistency, initial pH 7.5, initial temperature 35° C., sodium bicarbonate at same level as active oxygen. Table 6 summarizes the bleaching results obtained from bleaching this pulp across the reaction time range of 1 to 100 minutes, at one level of application of the inorganic peroxide to the pulp.

TABLE 6

| Example No. | 27 | 28 | 29 | 30 | 31 | 32 |
|---|---|---|---|---|---|---|
| Time (minutes) | 1 | 3 | 8 | 15 | 40 | 100 |
| OXONE (% on pulp | 0.25 | 0.25 | 0.25 | 0.25 | 0.25 | 0.25 |
| $NaHCO_3$ (% on pulp | 0.25 | 0.25 | 0.25 | 0.25 | 0.25 | 0.25 |
| GEB | 65.3 | 65.3 | 66.2 | 68.0 | 70.0 | 72.2 |
| Visc.(cps) | 11.18 | 10.51 | 10.73 | 10.66 | 11.00 | 11.00 |
| Change in GEB | 3.8 | 3.8 | 4.7 | 6.5 | 8.5 | 10.7 |
| Change in Visc. | 0.92 | 0.25 | 0.47 | 0.40 | 0.74 | 0.74 |

Figure 4:
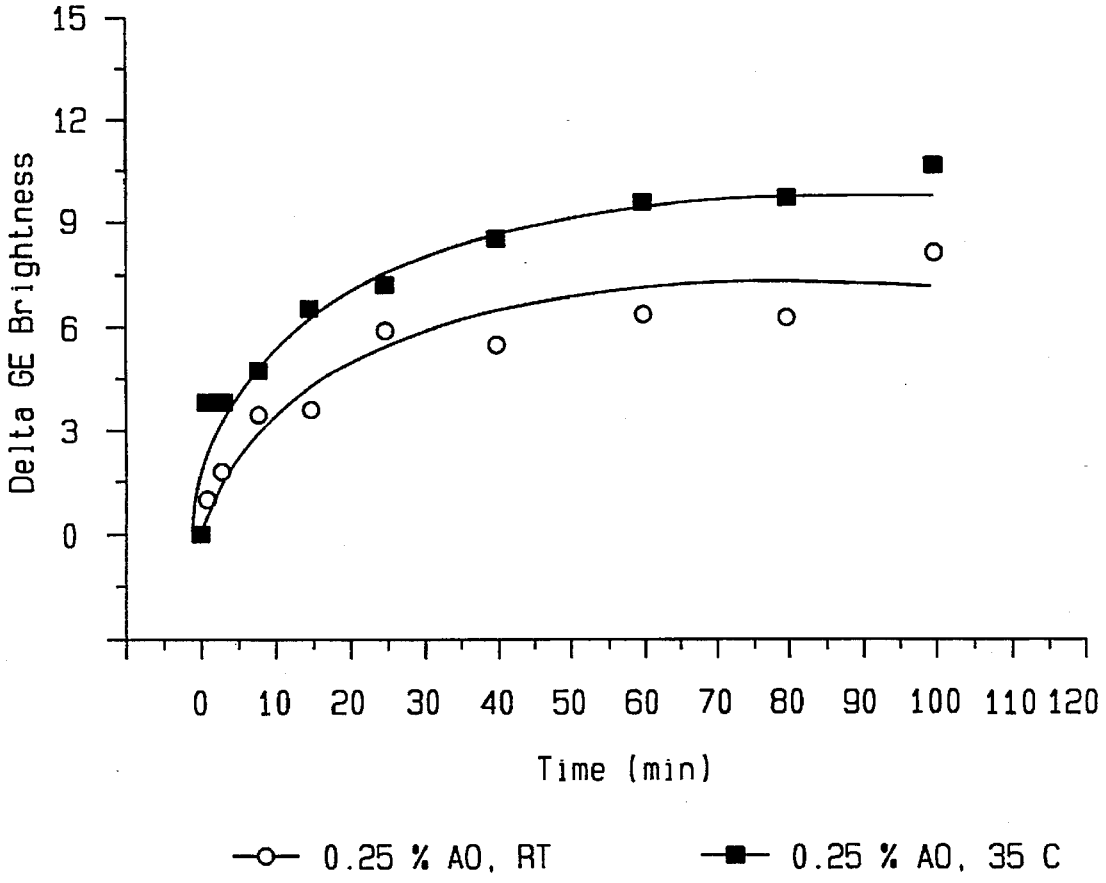
FIG. 4 is a plot of change in GE brightness versus time at two different temperature levels.

The results reported in Table 6 shows pulp viscosity increases as well as significant brightness increases following OXONE bleaching of kraft/OZ pulp at a slightly elevated temperature. The brightness results shown in Table 6 are further analyzed in FIG. 4 in the plot of GE brightness versus reaction time. As this data demonstrates, both the initial rate of pulp brightening and the ceiling brightness level are positively affected by increasing the reaction temperature from 25° C. to 35° C. Of interest also is that there is apparently no negative impact of this slightly elevated temperature on pulp viscosity. In fact, viscosity enhancements are measured across the reaction time range studied. However, at some point in the temperature range 35°–80° C., the use of higher temperatures does begin to decrease the strength of the pulp as measured by its viscosity. See Comparative Example A hereinbelow.

Comparative Example A: High-Temperature Oxidation of

Ozone-Bleached Pine Pulp

A Kraft-AQ pulp was oxygen-bleached, ozone-bleached, alkaline-extracted, and peroxide-bleached to a GE Brightness of 79.8, and a viscosity of 10.06 cp. A 10% consistency batch of the pulp was treated with potassium peroxymonosulfate for one hour at 80° C. (initial pH 7.5). The pulp was washed well and tested to determine GE Brightness, and viscosity in accordance with the procedures indicated above. The results are indicated in Table 7.

TABLE 7

| Example No. | A |
|---|---|
| $KHSO_5$ (%) | 1.0 |
| GEB | 81.6 |
| Visc.(cp) | 9.24 |
| Change in GEB | 1.8 |
| Change in Visc. | −0.82 |

As the data in Table 7 indicates, pulp brightness can be increased with potassium peroxymonosulfate at 80° C., but increase in brightness at this elevated temperature—in addition to having an energy cost—also incurs a relatively high cost in pulp viscosity level.

While it is apparent that the invention herein disclosed is well calculated to fulfill the objectives stated above, it will be appreciated that numerous modifications and embodiments may be devised by those skilled in the art. For example, one may utilize one or more of the process steps described in U.S. patent application No. 08/116,776 and U.S. Pat. No. 5,409,570 in combination with the presently claimed inorganic peroxy acid salt bleaching step. Thus, the content of those applications is expressly incorporated herein by reference thereto. Furthermore, it is intended that the appended claims cover all such modifications and embodiments as fall within the true spirit and scope of the present invention.

What is claimed is:

1. A process for the manufacture of a bleached pulp having enhanced brightness which comprises chemically digesting a lignocellulose material to initially form a pulp, then subjecting the pulp to one or more separate bleaching or delignification stages to form a partially delignified pulp, and then, in a separate stage, subjecting the partially delignified pulp to an inorganic peroxy acid salt at an initial pH of at least about 7 at ambient temperature for a period of time sufficient to increase the brightness of said partially delignified pulp by at least about 5 GEB %, wherein said inorganic peroxy acid salt is applied to the pulp as the final brightening stage of the process, and the action of said inorganic peroxy acid salt does not substantially lower the strength of said pulp.

2. The process of claim 1, in which the amount of said peroxy acid salt contacting the pulp is between about 0.1 and 4% by weight based on the oven dry weight of the pulp and in which the temperature of said partially delignified pulp is about 40° C.

3. The process of claim 1, in which said peroxy acid salt is potassium peroxysulfate.

4. The process of claim 1, in which the partially delignified pulp is obtained by treatment with at least one of oxygen, ozone, a peroxide compound, chlorine or chlorine dioxide.

5. In a process for the manufacture of a bleached pulp having enhanced brightness which comprises chemically digesting a lignocellulosic material to initially form a pulp and then partially delignifying said pulp in one or more separate stages which include oxygen, ozone or a peroxide compound, the improvement which comprises subjecting the resulting partially delignified pulp in a subsequent process step to the action of an inorganic peroxy acid salt at an initial pH of at least about 7 to 9 at ambient temperature for a period of time sufficient to increase the brightness of said partially delignified pulp by at least about 5 GEB %, wherein said inorganic peroxy acid salt is applied to the pulp as the final brightening stage of the process, and the action of said inorganic peroxy acid salt does not substantially lower the strength of the pulp.

6. The process of claim 5, in which the amount of said peroxy acid salt contacting the pulp is between about 0.1 and 4% by weight based on the oven dry weight of the pulp and in which the temperature of said partially delignified pulp is about 25° C.

7. The process of claim 5, in which said peroxy acid salt is potassium peroxysulfate.

8. The process of claim 5, in which the pulp is partially delignified in two or more of said stages.

9. A process for the manufacture of a bleached pulp having a certain GE brightness and a certain strength as indicated by a certain viscosity which comprises:

chemically digesting a lignocellulosic material to initially form a pulp;

oxygen delignifying the pulp to remove a substantial portion of the lignin therefrom, with the combination of the digesting and oxygen delignifying steps being conducted to form an intermediate pulp having a specified amount of lignin and a specified viscosity;

ozone delignifying the intermediate pulp with a gaseous mixture that contains ozone in a reaction zone to remove a substantial portion, but not all, of the remaining lignin to form a delignified pulp having a reduced amount of lignin and the certain strength, viscosity and brightness;

wherein the specified amount of lignin of the intermediate pulp is such that, after ozone delignification thereof, the delignified pulp attains the certain GE brightness, and wherein the specified viscosity of the intermediate pulp is sufficiently high to permit the delignified pulp, after ozone delignification thereof, to attain the certain strength as evidenced by the certain viscosity;

increasing the certain brightness of the ozone delignified pulp by subjecting the pulp to a brightening sequence which comprises:

treating the delignified pulp with a peroxide compound under conditions sufficient to raise the certain brightness of the pulp to a first increased brightness which is higher than the certain brightness;

then treating the resulting pulp with ozone under conditions sufficient to raise the first increased brightness of the pulp to a second increased brightness which is higher than the first increased brightness; and subsequently treating the resulting pulp with a salt of an inorganic peroxy acid at ambient temperature and an initial pH of at least about 7 for a period of time sufficient to raise the second increased brightness to a third increased brightness which is higher than the second increased brightness, wherein said inorganic peroxy acid salt is applied to the pulp as the final brightening stage of the process, and the action of said inorganic peroxy acid salt does substantially lower the strength of the pulp.

10. The process of claim 9 wherein the peroxy acid salt treatment comprises providing the consistency of the ozone brightened pulp at between about 8–35% and contacting the pulp with between about 0.1 and 4% by weight based on the oven dry weight of the pulp of an inorganic peroxide salt compound at a temperature of about 40° C. for a sufficient time to achieve the third increased brightness.

11. The process of claim 10 wherein the amount of peroxy acid salt compound used in the subsequent peroxy acid salt treatment step is between about 0.2 and 0.5% and which further comprises treating the pulp with a peroxide stabilizing agent prior to conducting the subsequent peroxy acid salt treatment.

12. The process of claim 9 wherein the pulp is washed between brightening treatments, and the certain brightness is between about 48 and 80 GEB, the first increased brightness is between about 65 and 90 GEB and is increased by at least about 10 to 20 GEB over that of the certain brightness, the second increased brightness is between about 78 and 92 GEB and is increased by at least about 2 to 13 GEB over that of the first increased brightness, the third increased brightness is between about 83 and 93 GEB and is increased by at least about 1 to 5 GEB over that of the second increased brightness.

13. The process of claim 9 which further comprises conducting an alkaline extraction on the pulp after the ozone delignifying step.

14. The process of claim 13 wherein the alkaline extraction step is conducted by contacting the pulp with a solution of an alkaline material for a sufficient time and at a sufficient temperature to solubilize a substantial portion of any lignin which remains in the pulp prior to the brightening sequence.

15. The process of claim 13 which further comprises treating the pulp with an additive to prevent loss of viscosity during the extraction treatment.

16. The process of claim 15 wherein the additive is sodium borohydride, formamidine sulfinic acid, or sodium hydrosulfite.

17. The process of claim 9 wherein the ozone brightening treatment comprises reducing the pH of the peroxide treated pulp to less than about 7 and contacting the pulp at a consistency of about 1–18% with a sufficient amount of ozone to achieve the second increased brightness.

18. The process of claim 9 wherein the ozone brightening treatment comprises reducing the pH of the peroxide treated pulp to less than about 4 and contacting the pulp at a consistency of about 5–15% with an amount of ozone of between about 0.01 and 0.5% by weight based on the oven dry weight of the pulp to achieve the second increased brightness.

19. The process of claim 9 wherein the ozone delignification of the pulp is carried out by dispersing the pulp substantially completely throughout the reaction zone while simultaneously conveying the pulp through the reaction zone in a plug flow-like manner at a dispersion index of about 7 or less thus exposing substantially all of the pulp to the ozone for reaction therewith.

20. The process of claim 9 wherein the ozone delignification of the intermediate pulp is carried out by:

introducing high consistency pulp into the reaction zone at a fill level of at least about 10%;

introducing the ozone containing gaseous mixture into the reaction zone for contact with the pulp; and intimately contacting and mixing the pulp with the ozone by lifting, displacing and tossing the pulp in a radial direction to disperse the pulp and expose substantially all of the pulp to the ozone containing gaseous mixture while advancing the dispersed pulp axially through the reaction zone in a plug-flow like manner and at a dispersion index of below about 7 for a predetermined time to obtain substantially uniform bleaching of the pulp and to form a bleached pulp having the certain GE brightness, certain strength and certain viscosity.

21. The process of claim 9 wherein the ozone delignifying step comprises:

increasing the consistency of said intermediate pulp to at least about 28%;

comminuting the increased consistency pulp into discrete particles of a predetermined particle size having a sufficiently small diameter and a sufficiently low density to facilitate substantially complete penetration of a majority of the pulp particles by ozone gas without causing significant degradation of the cellulose components of the pulp; and uniformly contacting said comminuted pulp particles with said ozone containing gaseous mixture during turbulent mixing while the pulp is advanced through the reaction zone for a sufficient time to obtain substantially uniform delignification of a majority of the pulp particles.

22. The process of claim 9 which further comprises:

comminuting the pulp into pulp particles having a relatively low bulk density prior to introducing said pulp particles into the reaction zone; and maintaining a substantially constant and predetermined fill level of said pulp particles in the reaction zone by initially advancing said relatively low bulk density pulp particles at a first rate thus increasing the low bulk density of the pulp particles, and then advancing said increased bulk density particles at a second rate less than said first rate.

23. The process of claim 9 wherein the oxygen delignification step comprises forming a low to medium consistency pulp; treating the low to medium consistency pulp with an aqueous solution of an alkaline material for a predetermined time and at a predetermined temperature relative to the quantity of the alkaline material to substantially uniformly distribute the alkaline material throughout the low to medium consistency pulp; raising the consistency of the pulp to a high consistency; and subjecting the resulting high consistency pulp to high consistency oxygen delignification to obtain the intermediate pulp.

24. The process of claim 23 wherein the consistency of the pulp in the oxygen stage, prior to treatment with alkaline material, is reduced to less than about 5% by weight; at least some of the alkaline material is applied to the high consistency pulp; and at least a portion of the liquid obtained from the consistency raising step is directly recycled to the pulp treating step.

25. The process of claim 9 wherein said ambient temperature is within the range of 20° to 50° C.

* * * * *